US005930891A

United States Patent [19]

Loving, Sr. et al.

[11] Patent Number: 5,930,891

[45] Date of Patent: Aug. 3, 1999

[54] AUTOMATED METHOD AND APPARATUS FOR CRIMPING A CONTACT

[75] Inventors: Darryl K. Loving, Sr., Orting; Ronald E. Novak, Seattle; Steve Frediani; Richard C. Krotzer, both of Kent; Hans Tittel, Seattle; Franklin D. Harsch, Newcastle, all of Wash.

[73] Assignee: The Boeing Company, Seattle, Wash.

[21] Appl. No.: 08/846,787

[22] Filed: Apr. 30, 1997

[51] Int. Cl.[6] ..... H01R 43/04

[52] U.S. Cl. ..... 29/861; 29/705; 29/753; 29/863

[58] Field of Search ..... 29/861, 715, 753, 29/863

[56] References Cited

U.S. PATENT DOCUMENTS

| | | | |
|---|---|---|---|
| 3,664,173 | 5/1972 | Haucke et al. | 72/424 |
| 4,178,679 | 12/1979 | Lichtenstein | 29/715 |
| 4,294,006 | 10/1981 | Bair et al. | 29/701 |
| 4,348,806 | 9/1982 | Eves et al. | 29/753 X |
| 4,443,936 | 4/1984 | Lazaro, Jr. | 29/863 |
| 4,835,855 | 6/1989 | Eaton et al. | 29/863 |
| 4,916,811 | 4/1990 | Uehara et al. | 29/863 |
| 4,951,369 | 8/1990 | Verrall | 29/753 |
| 5,152,162 | 10/1992 | Ferraro et al. | 29/753 X |
| 5,168,736 | 12/1992 | Enneper et al. | 72/4 |
| 5,195,042 | 3/1993 | Ferraro et al. | 364/468 |
| 5,271,254 | 12/1993 | Gloe et al. | 72/19 |
| 5,303,462 | 4/1994 | Chitwood et al. | 29/705 |
| 5,337,589 | 8/1994 | Gloe et al. | 72/11 |
| 5,511,307 | 4/1996 | Reiersgaard et al. | 29/863 |

*Primary Examiner*—Carl J. Arbes
*Attorney, Agent, or Firm*—Lawrence W. Nelson

[57] ABSTRACT

A device that automatically engages a contact, having a tip portion and a barrel portion, to a stripped end of an insulated wire. The apparatus includes a crimping gun having at least a pair of opposing jaws, and a push rod having a distal end that engages the tip portion of the contact and moves the contact to a pre-determined position between the jaws of the crimping gun. The device also includes a detector that sends out a signal upon sensing that the stripped end of the insulated wire has made contact with a rear most portion inside of the barrel portion of the contact, and a CPU in communication with the crimping gun and the detector. The CPU directs the crimping gun to crimp the contact to the stripped end of the insulated wire upon receipt of the signal from the detector.

11 Claims, 17 Drawing Sheets

FIG. 7D
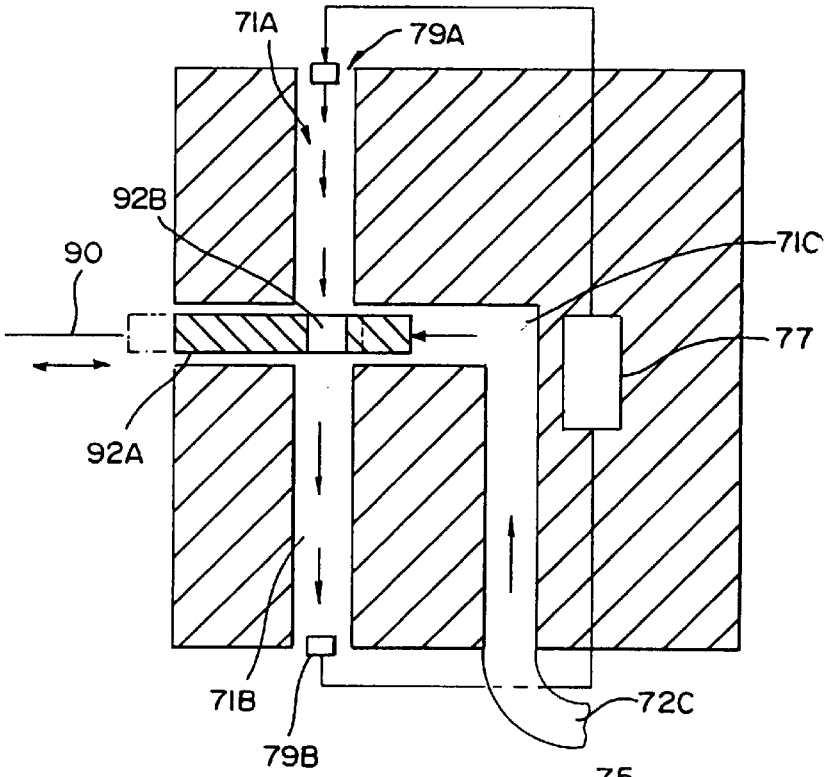
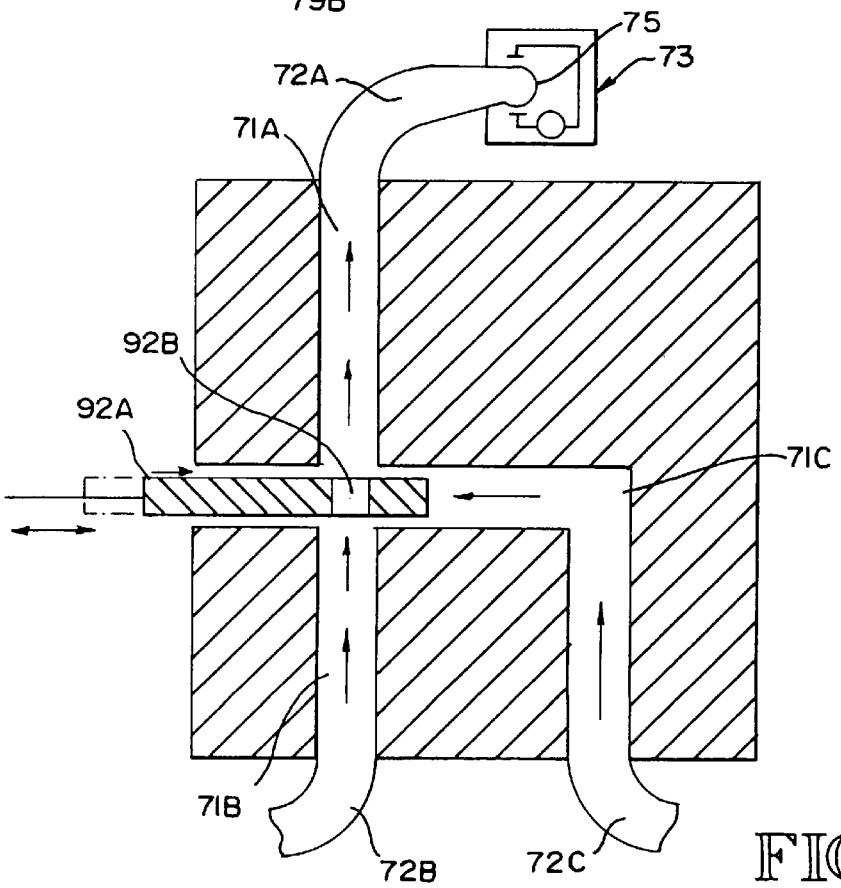
FIG. 7C

FROM FIG.11

FUNNEL CLOSE PUSHED?
230
Y
N
TURN VIB ON
232
CLOSE FUNNEL
234
FIRE GUN PUSHED
236
Y
N
TURN VIB ON
238
FIRE GUN
240
CLEAR PUSHED
242
Y
N
TURN VIB ON
244
EJECT SUBROUTINE
246
REGULAR CRIMP ACTIVATED
Y
N
TURN VIB ON
250
FIRE GUN
252
CONTACT IN PROPER POSITION ?
251
Y
N
OPEN FUNNEL
254
HAS FINISHED PRODUCT BEEN REMOVED ?
255
Y
N
CLOSE FUNNEL
256
RE-LOAD WITH WHATEVER
258
WHLLE(TRUE)

AUTOMATED METHOD AND APPARATUS FOR CRIMPING A CONTACT

BACKGROUND OF THE INVENTION

1. Field of the Invention

The present invention relates to a method and apparatus for crimping a contact onto a stripped end of a wire, and more particularly to a method and apparatus for crimping a contact automatically when the end of the wire has been properly inserted into the contact.

2. Background Information

Electrical systems, such as those used on aircraft, often use a cannon plug to connect a disconnectable system. A male plug of the cannon plug includes a group of male contacts called pins, each connected to the end of a respective wire. The female receptacle of the cannon plug includes a group of female contacts called sockets, which receive the pins, and which are also connected to the end of a respective wire. Crimping systems for crimping the contacts onto their respective wire ends are currently available from a number of manufacturers. The current crimping systems move a contact through a feeding mechanism so that the contact is aligned with a set of crimping jaws of a crimping mechanism so that when the jaws close, the contact is deformed around the end of a wire.

FIGS. 1A and 1B show an example of a current crimping system 500. The system 500 has a vibratory bowl 502 used for directing contacts 504 into a guide block 506, where the contacts 504 are moved up into a crimp gun 508, where they are permanently coupled to the end portion 521 of a wire 523. The vibration of the bowl 502 moves the contacts 504 up and onto a track 510. An air line 512 is located with an outlet at the top of the bowl 502 and blows contacts that are not properly aligned back into the bowl 502. The contacts 504 that are properly aligned transfer onto guide rails 514 where they are moved in line to the guide block 506 to a rear side of an alignment opening 516. A piston 517 lifts the contact 504 through the back side of the alignment opening 516 and into a pair of jaws 519 of the crimp gun 508, as shown in FIG. 1B, when an operator depresses a foot pedal 518, shown in FIG. 1A. The end portion 521 of the wire 523 is placed into a front side of the alignment opening 516 through a guide opening 525, which leads to the crimp gun 508, and into a barrel portion 527 of one of the contacts 504. The operator then releases the pedal 518 to activate the crimp gun 508 which crimps the conductive portion 521 of the wire 523 to the contact 504. The crimped assembly (not shown) is then removed.

Although the crimping system 500 is faster than manually aligning the contact 504 and the wire end within the crimp gun 508, the system has a number of limitations. First, the system can only accommodate one type of contact. If an operator desires to use another type of contact, the entire contents of the bowl 502 and rail 514 must be removed and the new type of contacts loaded. If a separate bowl and rail were installed to deliver another contact, then the gun 508 would have to be repositioned with another alignment hole each time the type of contact was changed. Further, the rails tend to jam and are easily damaged making the machine highly unreliable.

Yet another problem with the current system is the need of the operator to prepare the machine for crimping by depressing a foot pedal and then physically hold a wire in the proper position in a contact while releasing the foot pedal 518 to activate the gun 508. The use of the foot pedal 518 and the delay caused by manual activation of the gun 508 introduce production time inefficiencies and delays and increase the chance that the wire end will be moved out of position before the gun 508 is activated. Accordingly, there is a need for a crimping system that accommodates a plurality of types of contacts without requiring significant reconfiguration of the system to change the type of contact. Further, there is a need for a system that automatically senses that the wire end is properly seated in the contact and commences the crimping operation.

SUMMARY OF THE INVENTION

In accordance with one aspect, the present invention relates to a method for automatically coupling a contact having a tip portion and a barrel portion to a stripped end of an insulated wire using a crimping gun having at least a pair of opposed jaws. The method comprises the steps of: transporting a contact to a predetermined position between the pair of opposed jaws of the crimping gun, feeding the stripped end of the insulated wire into the barrel portion of the contact, and sensing that the stripped end of the insulated wire has made contact with a rear most portion inside of the barrel of the contact and sending out a first signal. The method further comprises the step of actuating the crimping gun in response to the first signal in order to deformably couple the contact to the stripped end of the insulated wire.

In accordance with another aspect, the present invention relates to an apparatus for automatically engaging a contact having a tip portion and a barrel portion to a stripped end of an insulated wire. The apparatus comprises a crimping gun having at least a pair of opposing jaws, a push rod having a distal end that engages the tip portion of the contact and moves the contact to a pre-determined position between the jaws of the crimping gun, and a detector that sends out a first signal upon sensing that the stripped end of the insulated wire has made contact with a rear most portion inside of said barrel portion of the contact. The apparatus further comprises a CPU in communication with the crimping gun and the detector. The CPU directs the crimping gun to crimp the contact to the stripped end of the insulated wire upon receipt of the first signal from the detector.

BRIEF DESCRIPTION OF THE DRAWINGS

These and other features, aspects, and advantages of the present invention will become better understood with regard to the following description, appended claims, and accompanying drawings where:

FIG. 7C shows a top cross-sectional view of a trigger block and air dam of a first embodiment of the push assembly;

FIG. 7D shows a top cross-sectional view of a trigger block and air dam of a second embodiment of the push assembly;

DESCRIPTION OF A PREFERRED EMBODIMENT

FIGS. 2–5 show an embodiment of an automated crimping apparatus 20, which operates in accordance with the present invention. The crimping apparatus 20 includes a contact feed assembly 22, which serially feeds contacts stored in a plurality of vibratory bowls to a push assembly 28. The push assembly 28 precisely feeds and positions one of the contacts into the trigger assembly 30. The trigger assembly 30 is automatically activated when an operator has properly positioned the stripped end of a wire into a barrel portion of the contact that is in the trigger assembly 30. Once activated, the trigger assembly 30 crimps the contact onto the end of the wire and then allows an operator to remove the end of the wire, together with the crimped contact attached to it. A new contact is not fed into the trigger assembly until the operator removes the wire and crimped contact thus constantly modulating the crimp cycle time with relation to the ability and the speed of the operator. The contacts, described above, encompass not only pin and socket type contacts, but other types of contacts used to terminate the end of a wire.

Figure 5:
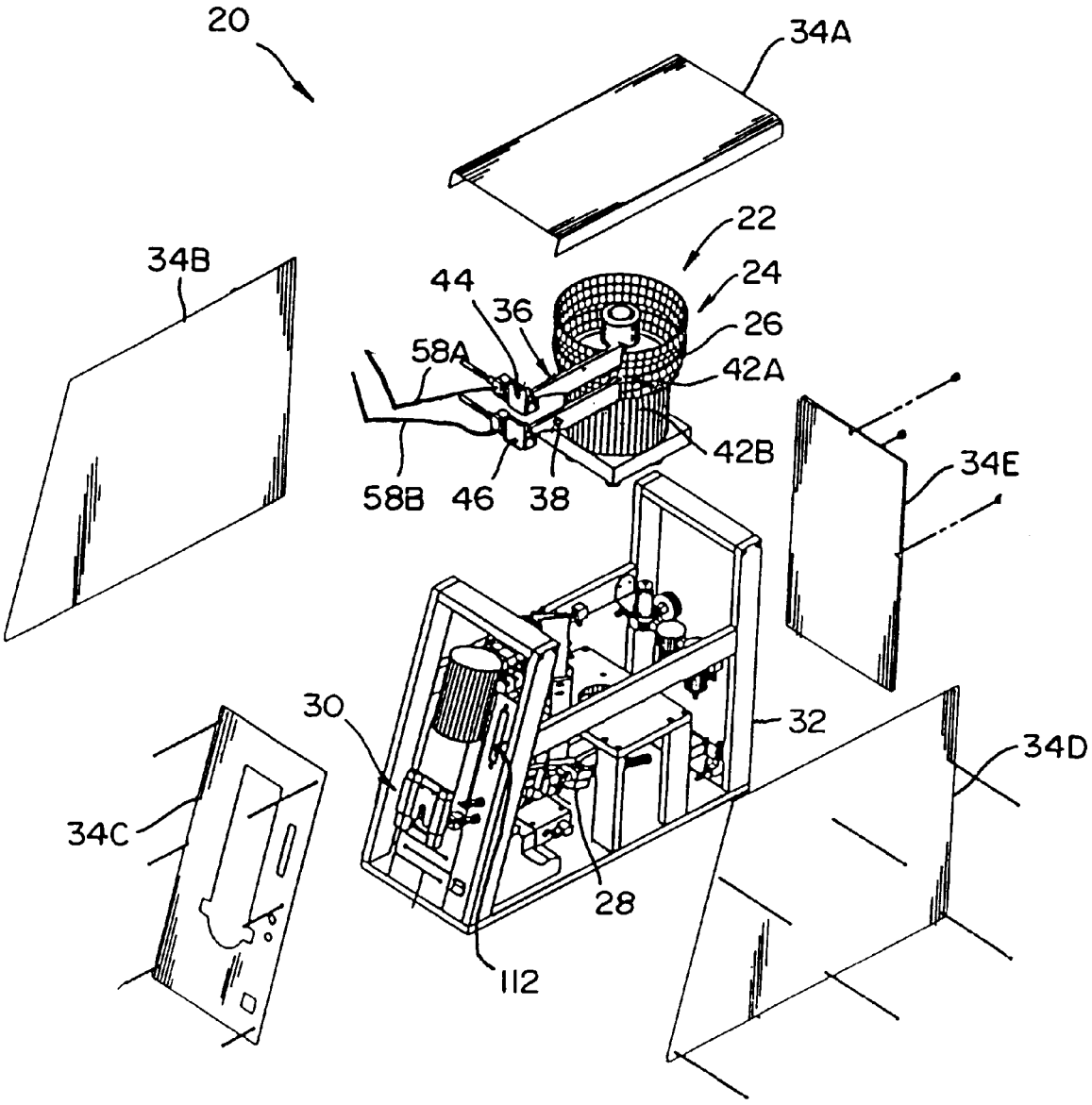
FIG. 5 shows an exploded view of the automated crimping apparatus.

The contact feed assembly 22, the push assembly 28, and the trigger assembly 30, are held in proper relation to one another by a metallic frame 32, as shown in FIG. 5. Further, the frame 32 is covered by panels 34A–34E to keep out dust and other extraneous matter.

Figure 10:
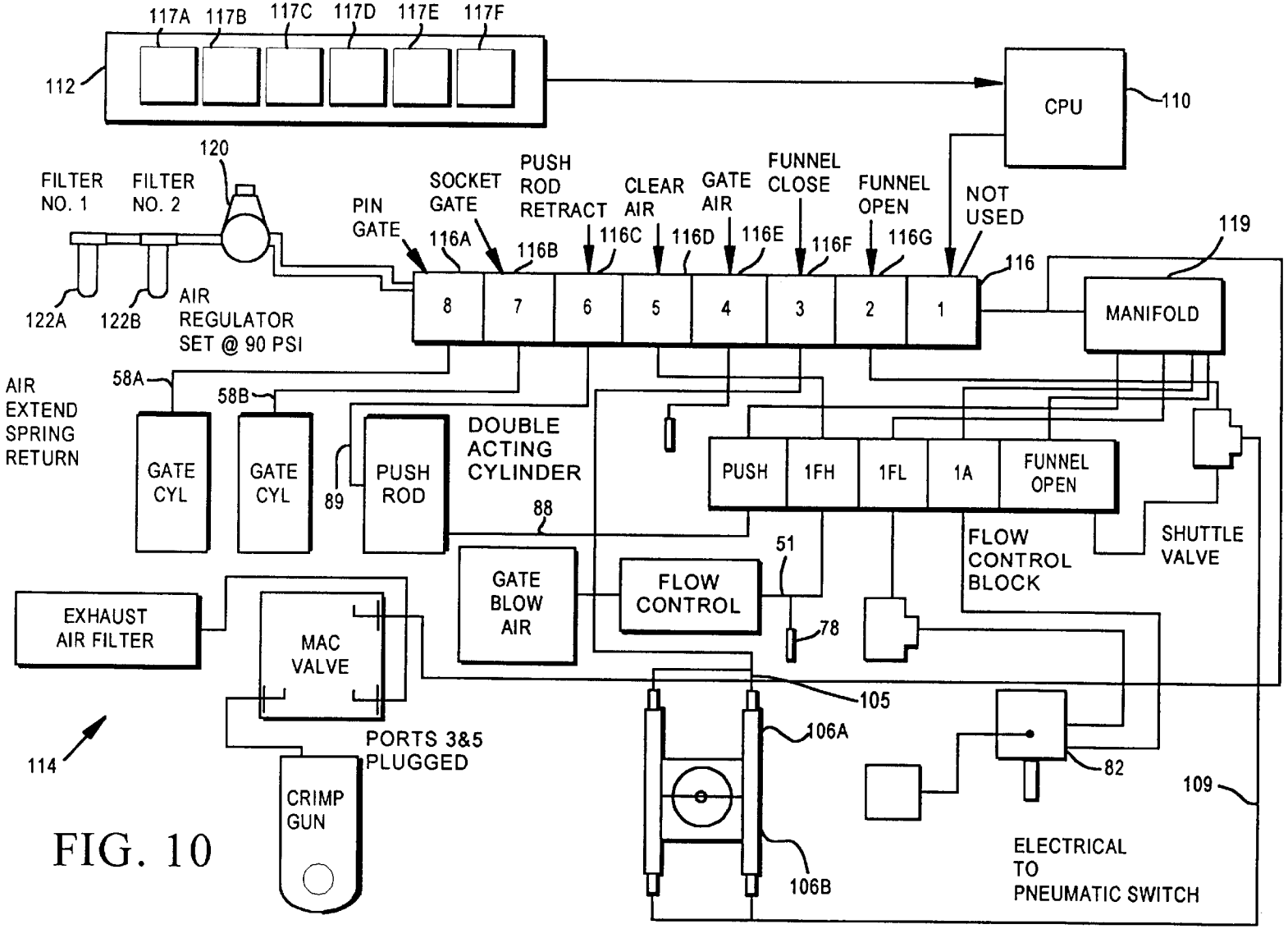
FIG. 10 shows a schematic diagram of a Central Processing United (CPU) controlled pneumatic system that operates the automated crimping apparatus.

The crimping apparatus 20 uses a pneumatic system 114, shown in FIG. 10, to drive the contact feed assembly 22, the push assembly 28, and the trigger assembly 30. The pneumatic system 114 is controlled by a central processing unit (CPU) 110. The crimping apparatus 20 is unique in that it uses only electric solenoid valves 116A–116G, which are controlled by the CPU 110 for all its operations.

Figure 3:
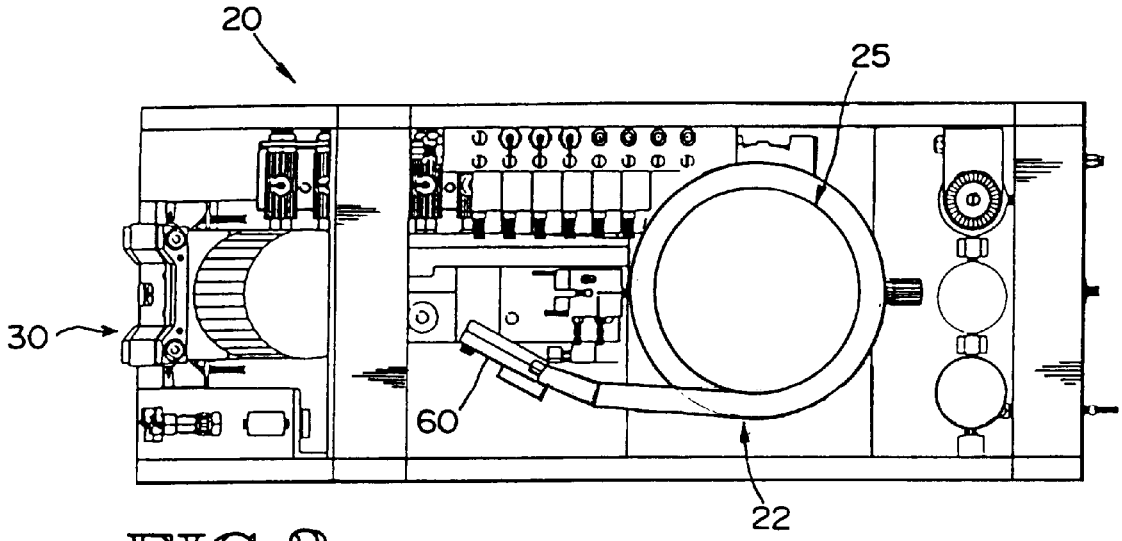
FIG. 3 shows a top view of the automated crimping apparatus.
Figure 4:
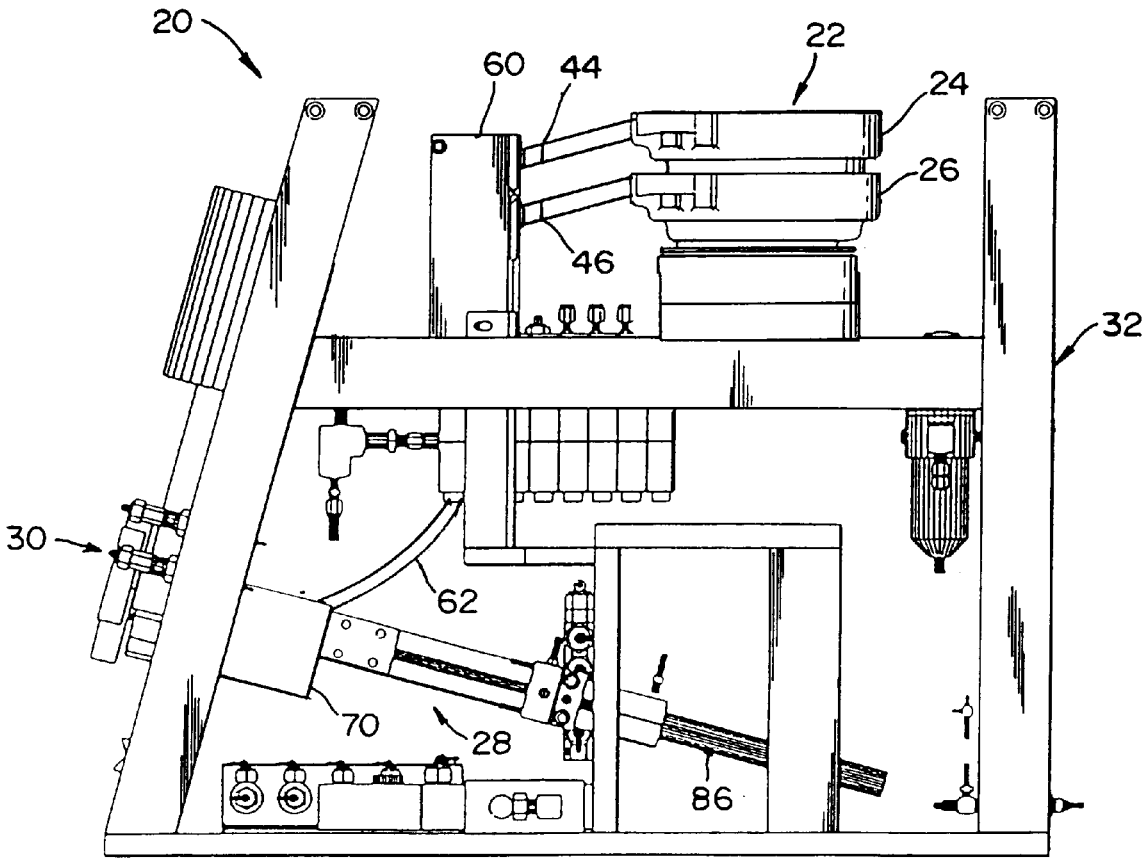
FIG. 4 shows a side view of the automated crimping apparatus.

The contact feed assembly 22, as shown in FIG. 5, includes two vibratory bowls, a first vibratory bowl 24 for sorting pins, and second vibratory bowl 26 for sorting sockets. Preferably, each of the first and second vibratory bowls 24 and 26 is an FMC Syntron™ vibratory parts feeder, the operation of which is well known in the art. The first and second vibratory bowls 24 and 26 each have a spiraling ramp 25 formed along their inner surface, which sequentially feeds contacts to respective rail assemblies 36 and 38, as shown in FIGS. 3–5.

Figure 6:
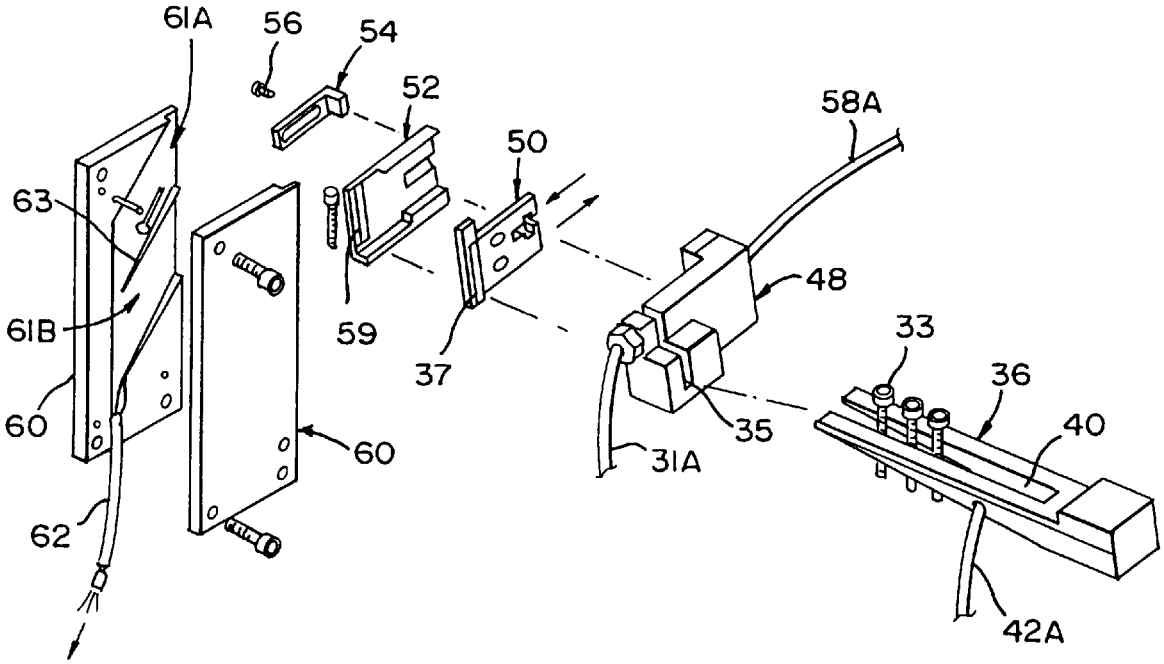
FIG. 6 shows an exploded view of a contact feeder assembly of the automated crimping apparatus.

The contacts are fed along the respective rail assemblies 36 and 38 in a vertical position, i.e. a "barrel portion" of the contact is perpendicular to the direction of travel, where the heavier tip portion of the contact drops through a slot 40 of the rail assemblies 36 and 38, shown in FIG. 6. The slot 40 is sized for the contacts being held, and is narrow enough to put the contacts into a single queue. The queue speeds up delivery of the contacts since the availability of the contacts is not dependent on the sorting speed of the first or second vibratory bowls 24 and 26. As in the prior art, rail air hoses 42A and 42B deliver an airflow which prevents jamming of the contacts that are being fed along the respective rail assemblies 36 and 38. The rail assemblies 36 and 38 can optionally be on a slight incline using gravity to deliver the contacts to a respective upper and lower gate assembly 44 and 46, as shown in FIG. 5. However, the momentum provided by the constant feeding of new contacts by the first and second vibratory bowls 24 and 26 is enough to drive the contacts toward the upper and lower gate assemblies 44 and 46.

Figure 1A:
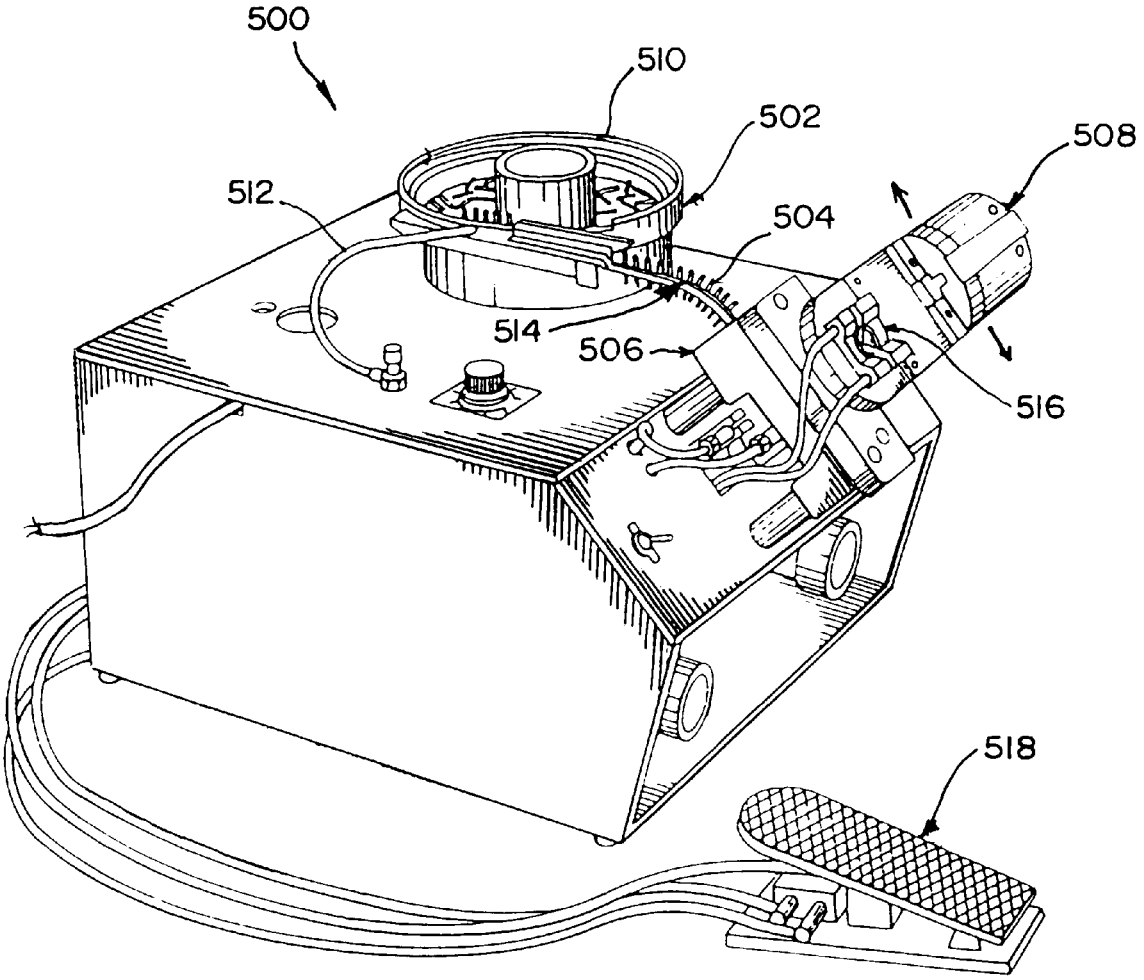
FIG. 1A PRIOR ART
FIG. 1A shows a prior art crimping system.
Figure 1B:
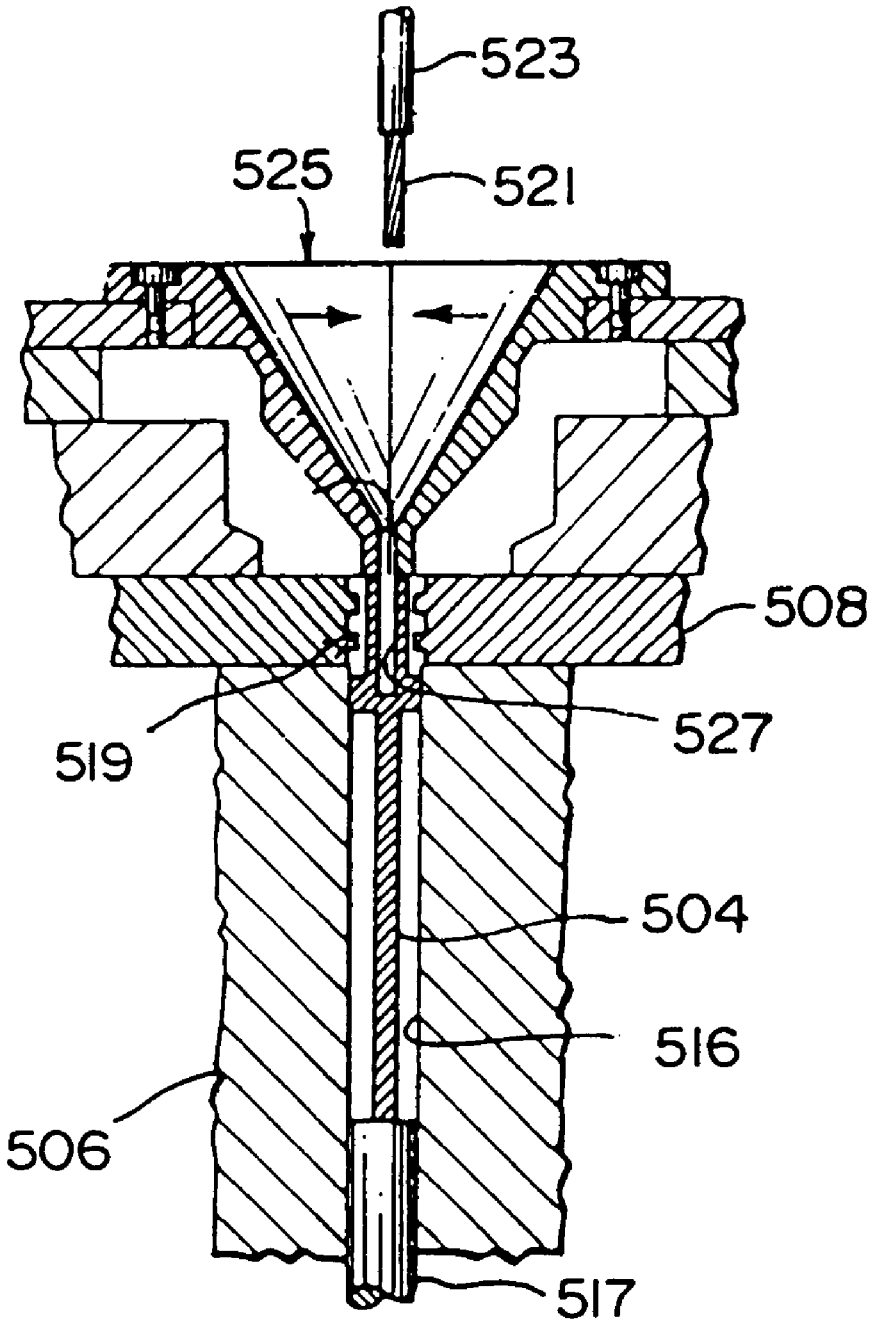
FIG. 1B PRIOR ART
FIG. 1B shows a cross-sectional view of a crimper gun and guide block of the prior art crimping system.
Figure 2:
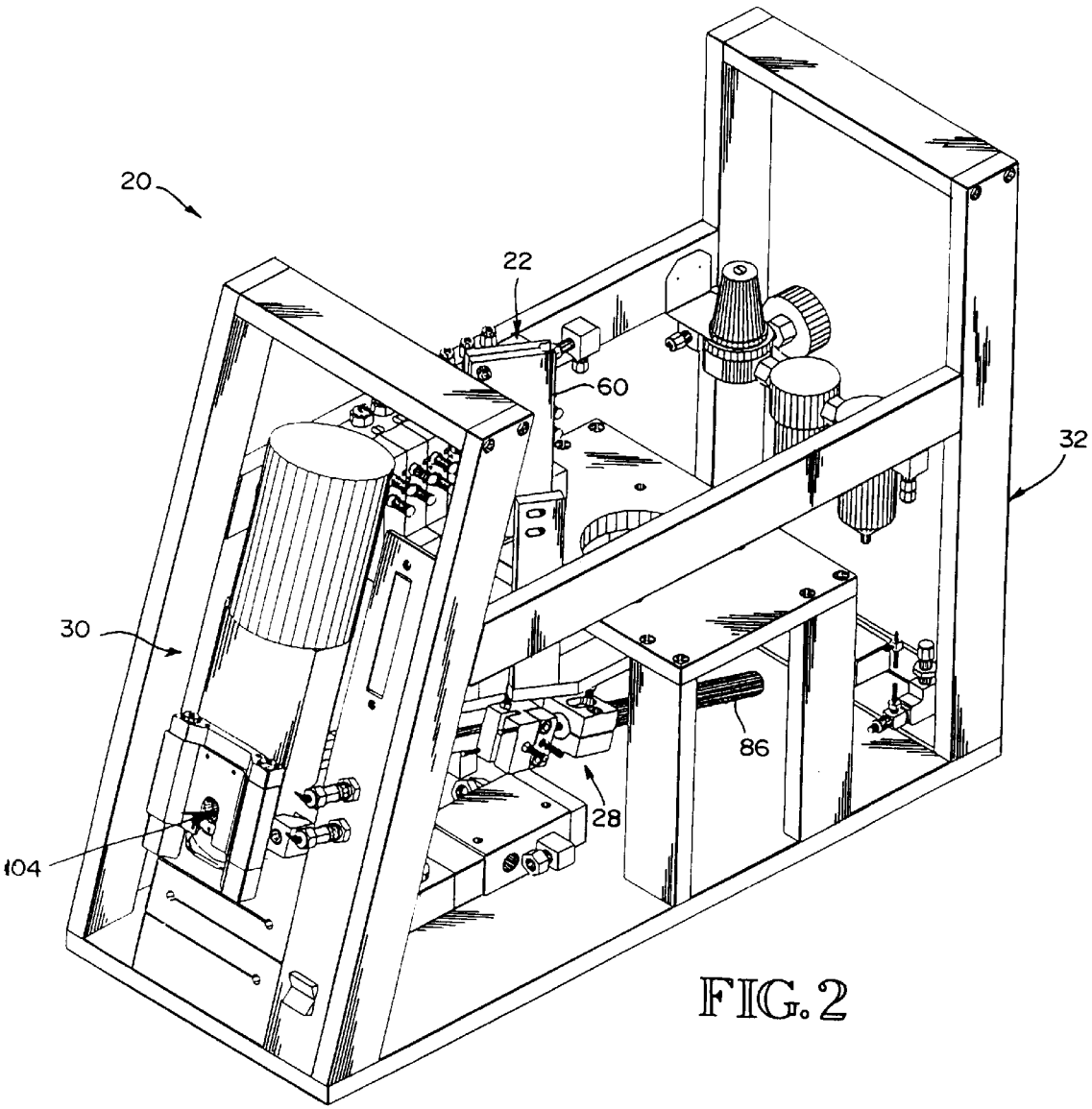
FIG. 2 shows an isometric view of an automated crimping apparatus as an embodiment of the present invention.

An exploded view of the upper gate assembly 44 is shown in FIG. 6. The gate assembly 44 includes an elbow 48, a gate 50, a gate cover 52, and a clamp 54 held together by a fastener 56. The upper gate assembly 44 is pneumatically controlled by air supplied via a first gate air hose 58A to allow sequential, individual, feeding of contacts from the rail assembly 36 to a catch funnel 60. The use of the upper gate assembly 44 replaces previous continuous rail assemblies, shown in FIG. 1, which were easily damaged and difficult to maintain.

A contact 33 is fed along the upper rail 36 in the slot 40, which is aligned with an elbow opening 35 in the elbow 48. The elbow opening 35 is sized to allow the contact 33 to pass through and onto the gate 50. The gate 50 has a gap 37, which is aligned with the elbow opening 35 when the gate 50 in an unactuated position. Preferably, the gate 50 is held in the unactuated position with a biasing spring (not shown). The gap 37 is only deep enough to accept the one contact 33. Once the contact 33 is properly seated within the gap 37, the gate 50 is pneumatically actuated via the first gate air hose 58A. The clamp 54 holds the gate cover 52 onto the elbow 48, and the gate 50 is slidable away from the first gate air hose 58A. Accordingly, during the pneumatic actuation the gate 50 shuttles the contact 33 away from the first gate air hose 58A moving only the one contact 33 into alignment with a first exit opening 59 in the gate cover 52. The contact 33 is then tipped over into an upper diagonal chute portion 61A of the catch funnel 60 by a continuous blast of air from first tipping air hose 31A. The lower gate assembly 46 has identical structure and operates in the same manner as the upper gate assembly 44, where the lower gate assembly 46 is actuated by a second gate air hose 58B and a contact is tipped over by a second tipping air hose 31B.

The catch funnel 60, shown in FIG. 6, is uniquely designed to allow the contact 33 to fall down the upper diagonal chute portion 61A into a feed tube 62 in a properly aligned position. The catch funnel 60 has the chute portion 61A and a lower chute portion 61B, which are separated from each other by a divider 63. The constant taper of the chutes 61A and 61B prevents the contact 33 from bouncing into the feed tube 62 which would cause a delay in the feed time. Each of the gate assemblies 44 and 46 feed into the catch funnel 60 through respective chutes 61A and 61B, and then into the single feed tube 62. The tapered chutes 61A and 61B ensure the proper positioning of a contact into the feed tube 62 (i.e., barrel portion of the contact leaving the funnel 60 first) and thereby eliminates the possibility of the contact becoming jammed as it enters the feed tube 62.

Figure 7A:
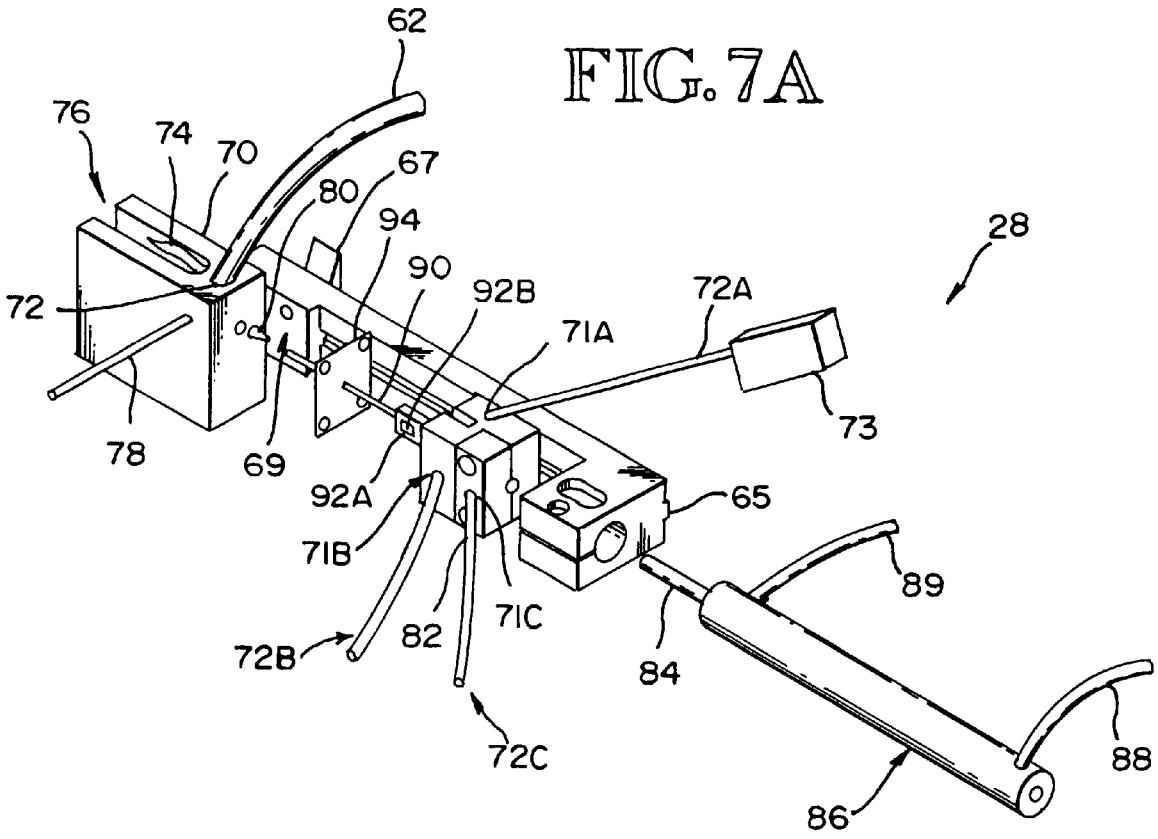
FIG. 7A shows an exploded view of a push assembly of the automated crimping apparatus.

The feed tube 62 services both the upper gate 44 and the lower gate 46 by receiving either a pin or a socket and delivering either the pin or the socket to a trough 70, as shown in FIGS. 4 and 7A. The feed tube 62 is oversized to accommodate the largest size contact to be delivered, and is constructed of a durable polymer which maintains a reduced friction environment, even after extensive use, such as Weatherhead™.

The feed tube 62 feeds the contact into a hole 72, which enters the trough 70 at a 30° angle, as shown in FIG. 7A. From the hole 72, the contact is gravity fed into a slot 76. However, before the contact enters the slot 76, it first comes into physical contact with a bounce eliminator 74, which is a thin piece of metal used to reduce the forward momentum of the contact. This insure that the contact is correctly seated in the slot 76. Further, the bounce eliminator 74 reduces delays potentially caused by the contact bouncing around in the slot 76. An air jet assembly fed by trough air hose 78 forces air into the slot 76 to insure that the contact is properly seated and ready for movement by the rest of the push assembly 28.

Figure 7B:
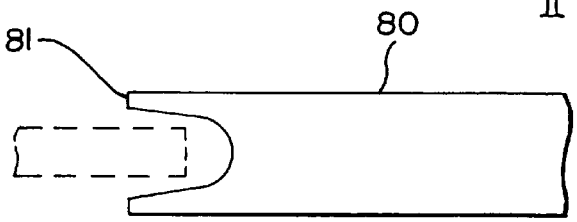
FIG. 7B shows a push rod of the push assembly.

The push assembly 28, as shown in FIG. 7A, pushes a contact into proper position relative to the trigger assembly 30. The tip portion of the contact is engaged by a push rod 80. A distal end 81 of the push rod 80, shown in FIG. 7B engages the tip portion of the contact. The end 81 is chamfered in such a way that it compensates for slight differences in length between contacts i.e., between the pins and the sockets it engages. The push rod 80 engages the pin and the sockets in a slightly different matter at a slightly different point at the end 81. For example, the pin, which is slightly longer, is also narrower, and therefore, seats deeper into the end 81 than the socket, causing the length of the rod 80 and pin combination and the length of the rod 80 and socket combination to be equal.

The push assembly 28 includes a cylinder mount 65, which holds a two-way send/receive fiber optic detector 67 that determines when the push rod 80 is in its proper position relative to the trigger assembly 30. This is accomplished by detecting the proximity of a trigger block 82 to openings 69 in the cylinder mount 65. The trigger block 82 is extended and retracted by a first piston 84 which is housed within a bore cylinder 86. The bore cylinder 86 is held in position by the cylinder mount 65. The first piston 84 is extended when air pressure is applied to one end of the bore cylinder 86, via cylinder extending air hose 88, and the first piston 84 is retracted when air pressure is applied to the other end of the bore cylinder 86, via cylinder retracting air hose 89.

The trigger block 82, as shown in FIGS. 7A and 7C, is coupled to a second piston 90 via a trigger air dam 92A having a dam orifice 92B. The secondary piston 90 is coupled to a cover 94. The cover 94 is coupled to the push rod 80. To properly seat a contact, air is applied through the cylinder extending air hose 88 which drives piston 84 and moves trigger block 82 towards the trough 70. When light transmitted through the hole 69 by the fiber optic detector 67 is reflected by the trigger block 82, the contact has been moved into its proper position within the trigger assembly 30, and the application of air pressure to cylinder air hose 88 is held constant.

The push assembly 28, as shown in FIGS. 7A and 7C, is sensitive to any force that moves the rod 80 in a direction toward the trigger block 82 once the contact has been properly positioned. The force triggers a pneumatic switch 73 linked to the trigger block 82 via line 72A, as shown in FIG. 7C. Normally, in an untriggered state, a constant stream of air flows from orifice 71C which is supplied by line 72C. The pressure is strong enough to keep the air dam 92A from moving within a flow path formed by orifices 71A and 71B when no external pressure is applied to the air dam 92A. However, when a force is applied to the rod 80 in the direction of the trigger block 82 and the cylinder 86, then the air dam 92A moves to position where the dam orifice 92B is within the flow path, allowing air supplied by line 72B to flow from the orifice 71B to the orifice 71A filling bag 75 and triggering the switch 73 by completing a circuit. The switch 73 informs the CPU 110, that it must perform a crimping operation. Movement of the air dam 92A, which is caused by the movement of the rod 80 toward the trigger block 82 and the cylinder 86, of as little as one two-thousandth of an inch will cause the dam orifice 92B to move into the air flow path and trigger pneumatic switch 73.

In an alternative embodiment, as shown in FIG. 7D, a send/receive fiber optic device 77 is used to detect any movement of the rod 80 by monitoring movement of the air dam 92A. The movement of the push rod 80 toward the trigger block 82 and the cylinder 86 is detected when a light beam from transmitter 79A is received by receiver 79B because of the movement of the dam orifice 92B of the air dam 92A into the "flow path" of the light beam.

Figure 8A:
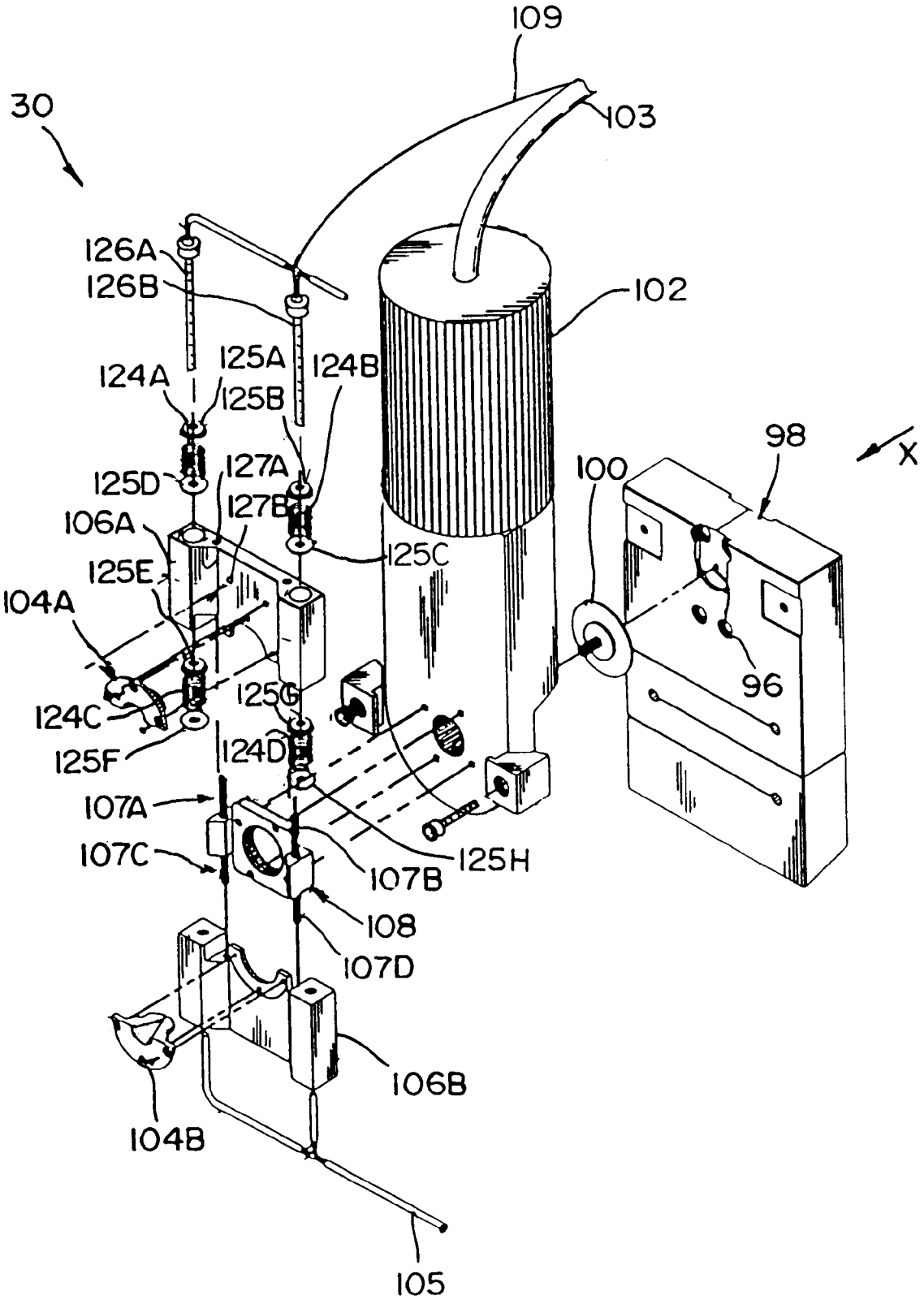
FIG. 8A shows an exploded view of a trigger assembly of the automated crimping apparatus.
Figure 8B:
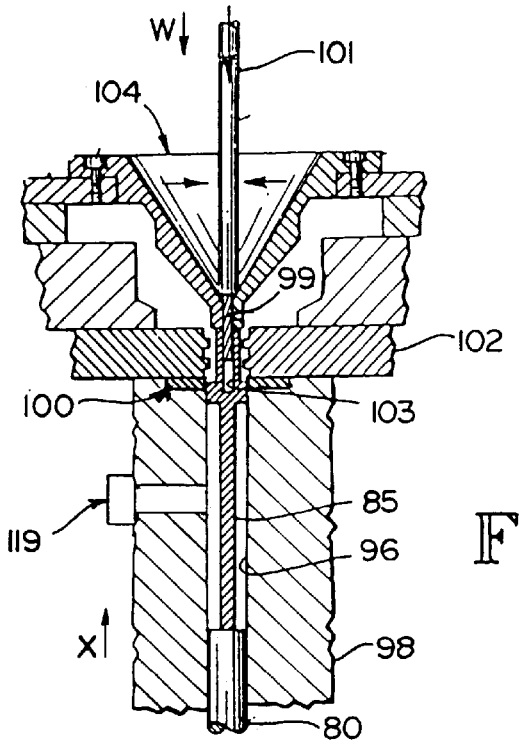
FIG. 8B shows a cross-sectional view of the trigger assembly as a wire is entering a contact.

The trigger assembly 30, as shown in FIGS. 8A and 8B, is properly loaded when a contact 85 is fed through an alignment hole 96 along direction X into a crimp gun mount 98 then through a guide bushing 100 until it is properly seated within a crimp gun 102, such as Daniels Manufacturing™ WA27XB Crimp gun. When in a closed position, a rear portion of an alignment funnel 104 acts as a stop to keep the contact 85 from moving forward. The alignment funnel 104, and the constant pressure applied by the end of the push rod 80 ensure that the contact 85 stays properly seated within the crimp gun 102.

A stripped end portion 99 of a wire 101 is slid into the alignment funnel 104 in the direction W, as shown in FIG. 8B, and is guided into a barrel portion 103 of the contact 85 seated within the crimp gun 102. Once the end portion 99 of the wire 101 is properly seated within the contact 85, the force of the stripped end 99 of the wire 101 bottoming out inside of the barrel portion 103 of the contact 85 provides a force in the direction toward the trigger block 82 and the cylinder 86 (see FIG. 2) which is detected by the movement of the air dam 92A in the trigger block 82, as shown in FIG. 7A. The switch 73, or alternatively, the fiber optic device 77, signals the CPU 110 to initiate a crimp cycle which causes the crimp gun 102 to fire.

The crimp gun mount 98 and bushing 100 are coupled to the rear of the crimp gun 102. A funnel mounting block 108 is mounted on the front of the crimp gun 102.

The alignment funnel 104, as shown in FIG. 8A, has an upper section 104A and a lower section 104B which are respectively fixed on an upper funnel body 106A and a lower funnel body 106B. Both the upper and lower funnel bodies 106A and 106B slide vertically with respect to pins 107A, 107B, and 107C, 107D, which are fastened to the funnel mounting block 108. The upper funnel body 106A is divided into an upper air cylinder 127A for closing the alignment funnel 104, and a lower air cylinder 127B for opening the alignment funnel 104. Each cylinder 127A and 127B is respectively comprised of upper springs 1247A–B, and lower springs 124C–D capped by upper cup seals 125A–D and lower cup seals 125E–H, respectively. Air is supplied to the lower air cylinder 127 for opening the alignment funnel 104 via air shafts 126A and 126B. The upper and lower funnel bodies 106A and 106B are driven to an open position with an air source provided along open funnel air hose 105, and are driven to a closed position with an air source provided along closed funnel air hose 109. The lower and upper funnel bodies 106A and 106B separate to allow the operator to remove a wire/contact combination from the front of the crimping apparatus 20.

Figure 8C:
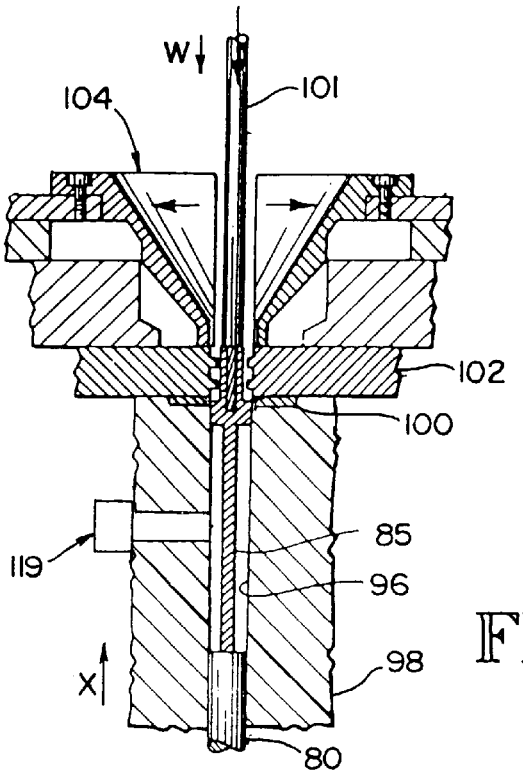
FIG. 8C shows a cross-sectional view of the trigger assembly when the wire is properly seated in the contact.
Figure 9:
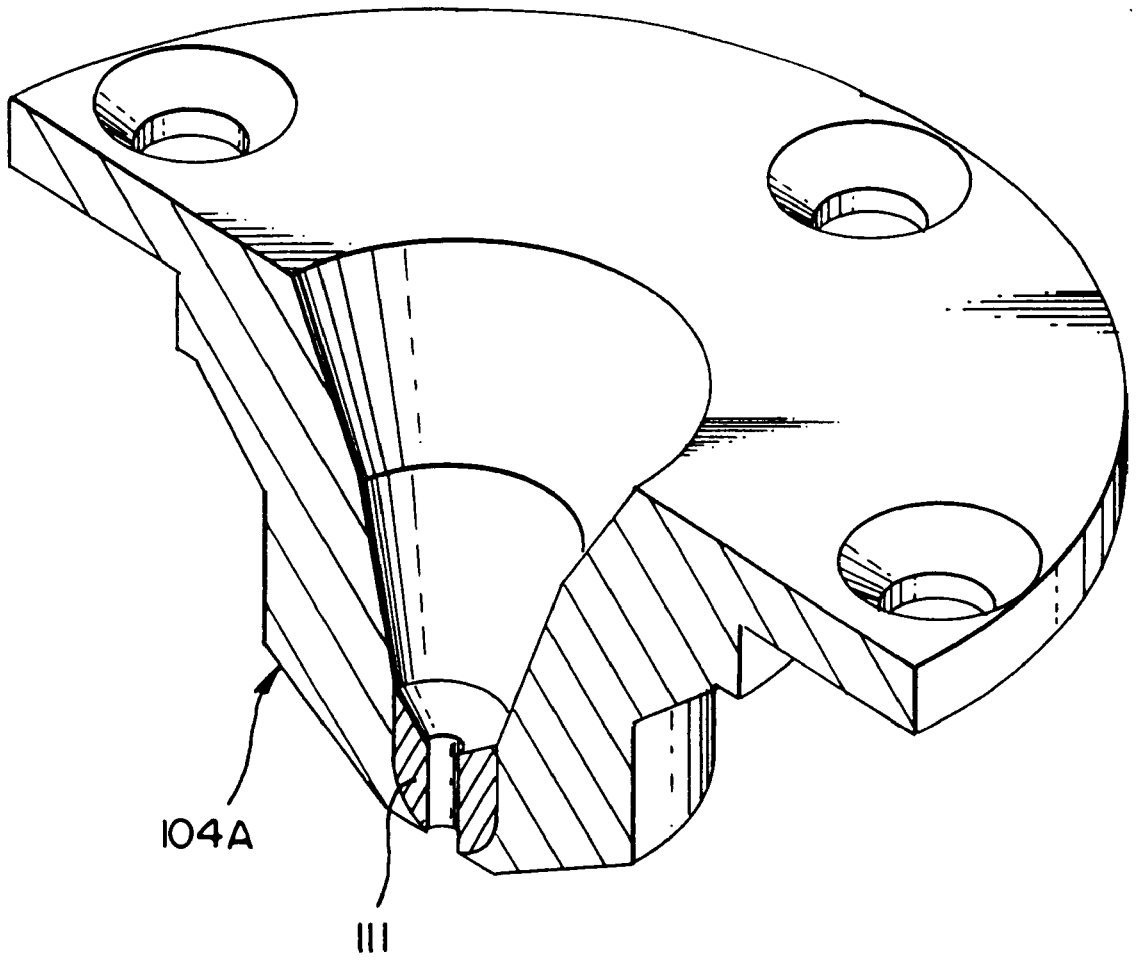
FIG. 9 shows an isometric view of an alignment funnel of the trigger assembly.

As shown in FIGS. 8A and 9, the alignment funnel 104 is designed to accept wire widths larger than the narrowest part of the inner portion of the alignment funnel 104. Slight air pressure is constantly applied via the open funnel air hose 105, and the closed funnel air hose 109 in such a manner that the pressure exerted to close the funnel bodies 106A and 106B is slightly less than the pressure exerted to open the funnel bodies 106A and 106B. This balance allows pressure from the wire 101 in the vertical direction to open the alignment funnel 104 slightly, so that the end portion 99 of the wire 101 can be completely seated in the barrel portion 103 of the contact 85, as shown in FIG. 8C. The inner sides 111 of the alignment funnel 104, as shown in FIG. 9, are contoured outwardly in a direction perpendicular to the direction of movement of the wire 101 and the funnel bodies 106A and 106B, since the opening movement of the alignment funnel 104 can only compensate in the vertical direction for a wire insulator size larger than the inner portion of the alignment funnel 104.

Preferably, a fiber optic sensor 119, shown in FIGS. 8B and 8C is positioned on the mounting block 98 and is used to detect if the contact 85 is present. The sensor 119 also determines if the crimped contact has been removed and whether the funnel 104 should be closed. A new contact is not fed into position when the sensor 119 detects that the former contact had not yet been removed. Thus, the system is sensitive to the speed at which the operator is able to use the device.

The pneumatic system, shown in FIG. 10, is controlled by the CPU 110, such as Z-World "Little Star" microprocessor. Under direction of the CPU 110, the crimping apparatus 20 is capable of limiting the time the vibration bowls 24 and 26 are switched on, while the apparatus 20 is not in use. This is usually set to five minutes. The CPU 110 using the pneumatic system 114 also directs the crimp gun 102 to fire when force is applied to push rod 80 in the direction of the trigger block 82.

The CPU 110 is controlled by a switch panel 112, shown in FIG. 10, which controls whether a pin or socket will be loaded into the crimp gun 102, by pressing switches 117A or 117B, respectively. The panel 112 also opens or closes the alignment funnel 104, by pressing switches 117C and 117D, respectively, and fires the crimp gun 102, or clears the trigger assembly 30, by pressing switches 117E and 117F, respectively. The pneumatic system 114 controls the air flow with the electric solenoid valves 116A–116G to air hoses 51, 58A, 58B, 78, 88, 89, 103, 105, 109 and to the trigger block 82. A constant supply of air is provided by a regulator 120, which is first filtered through filters 122A and 122B. The manifold 119 supplies a constant stream of air to various hoses and components.

Figure 11:
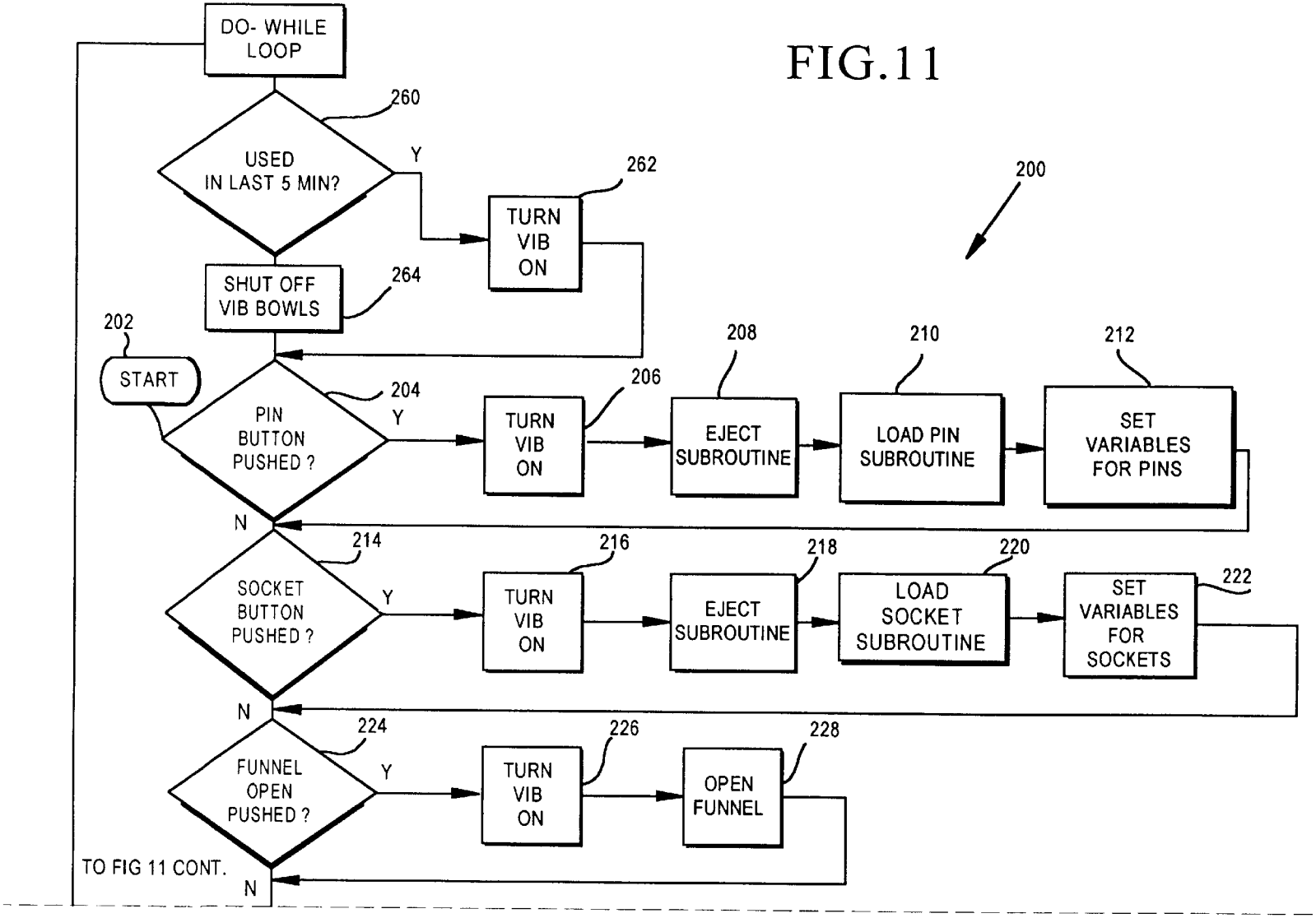
FIG. 11 shows a flow chart of a main program implementing a method of operating the automated crimping apparatus.
Figure 11:
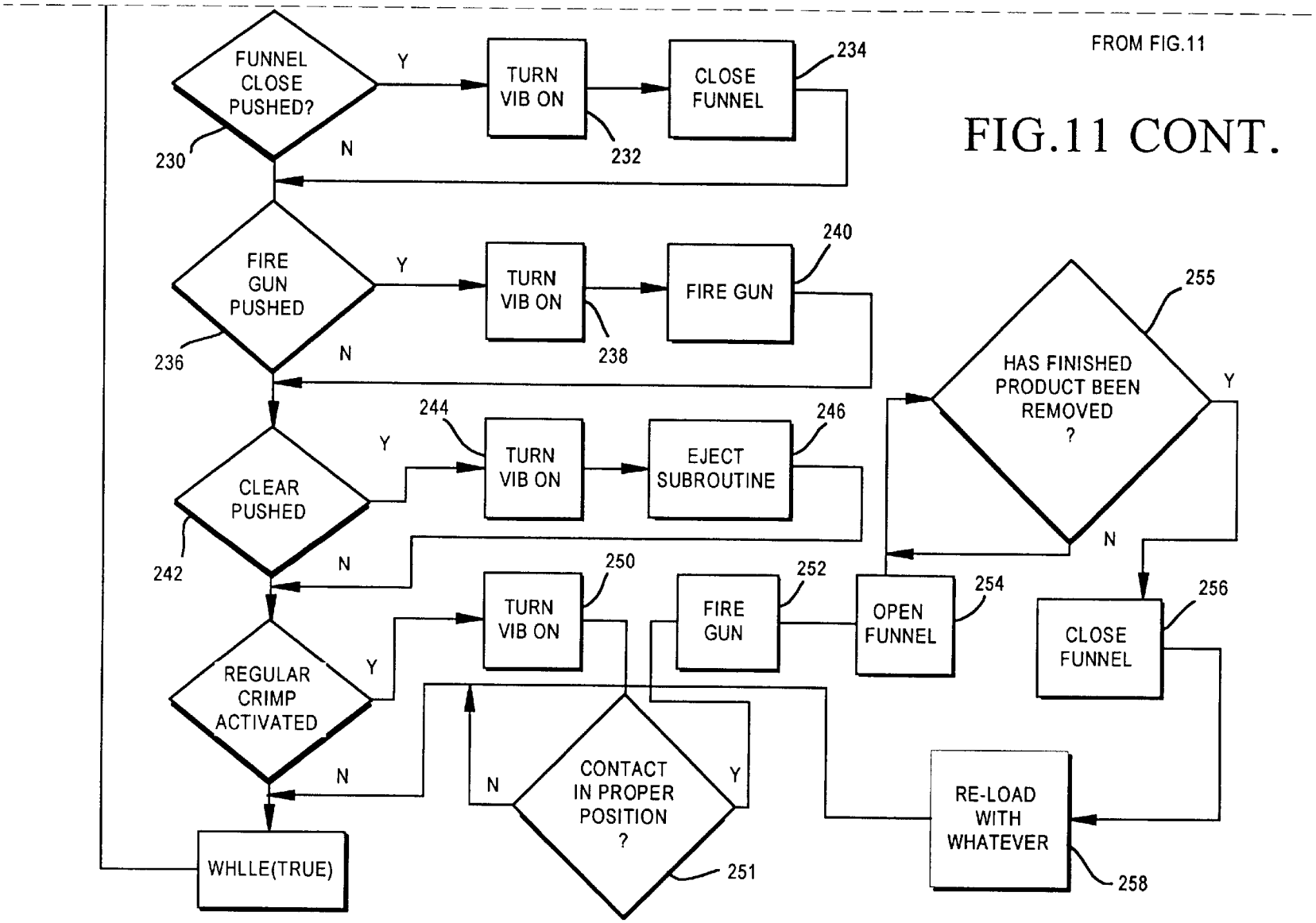

In a preferred embodiment, the CPU 110 is controlled by software that is stored as a series of program instructions in a memory of the CPU 110 to perform the process of operating the automated crimping apparatus. A flow chart from which source code can be written by one skilled in the art is illustrated in FIG. 11. Referring to FIG. 11, a main routine 200, which is executed by the processor 110 begins at step 202 when the apparatus is first turned on. The CPU 110 then proceeds to step 204, wherein it inquires as to whether the pin button 117A on panel 112, see FIG. 10, has been pushed. If so, the CPU 110 proceeds to step 206 and turns on the first and second vibrating bowls 24 and 26.

Figure 12:
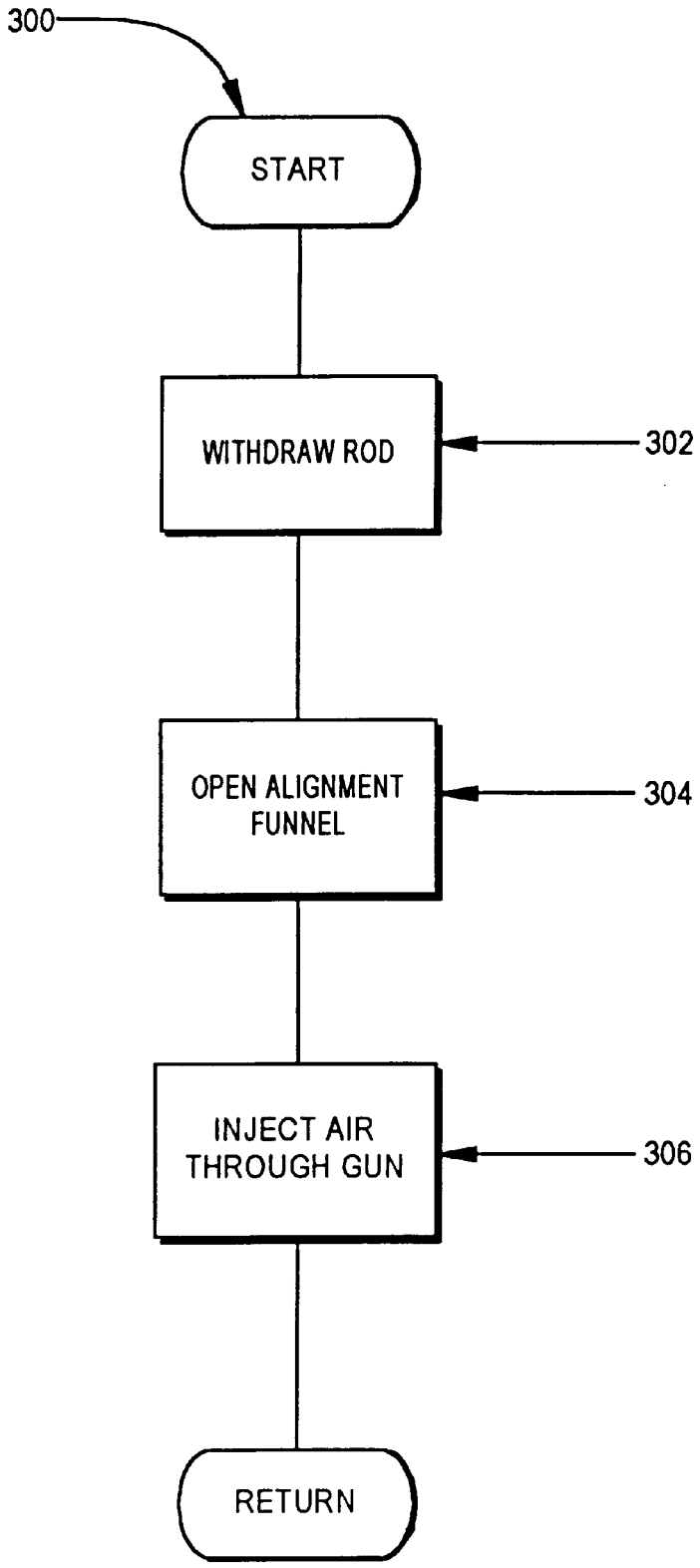
FIG. 12 shows a flow chart of a subroutine invoked to clear a contact from the automated crimping apparatus.

Next, the CPU 110 proceeds to step 208 and invokes subroutine 300, shown in FIG. 12, which is used to eject a contact currently located in the crimp gun 102. Initially, the subroutine 300, shown in FIG. 12, withdraws push rod 80 from trough 70, clearing the area between any contact present within the crimp gun 102 and the air supplied via trough air hose 78. Next, in step 304, the CPU 110 supplies air to upper alignment and lower alignment funnel bodies 106A and 106B via open funnel air hose 105 causing each to separate and clear away from funnel mounting block 108. Next, in step 306, the CPU 110 directs the pneumatic system to supply a high pressure burst of air through trough air hose 78 forcing the contact, if any, located within the crimp gun 102 out through the opening between the alignment funnel 104 and clear of the automated crimping apparatus 20. Then, the subroutine 300 returns to step 208 of the main routine 200, shown in FIG. 11.

Figure 13:
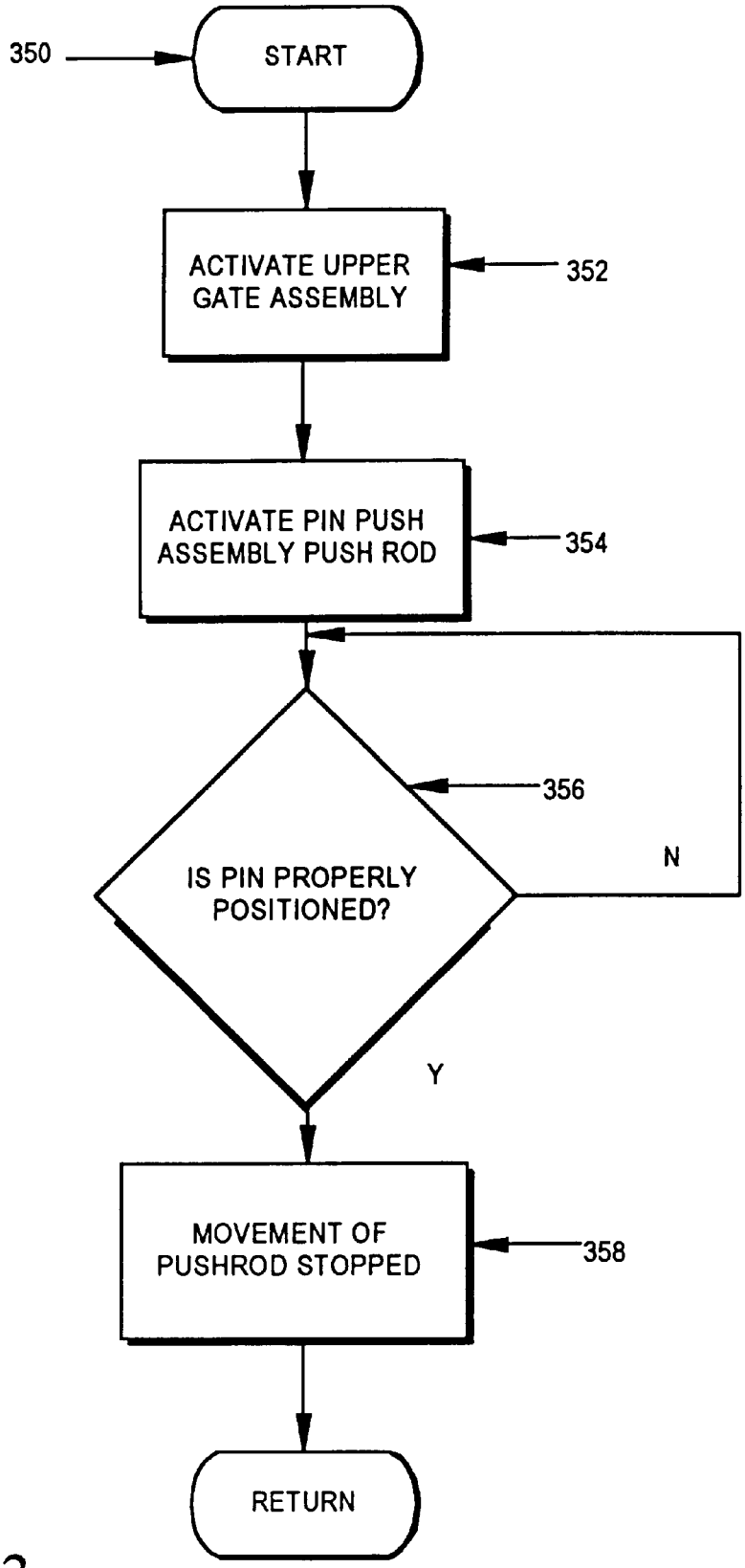
FIG. 13 shows a flow chart of a subroutine invoked to load a pin into proper position relative to the trigger assembly.

As shown in FIG. 11, the CPU 110 proceeds from step 208 to step 210, where it invokes subroutine 350, as shown in FIG. 13, which is used to load a pin into the crimp gun 102. Initially, the CPU 110 proceeds to step 352 of the subroutine 350. Here, the CPU 110 activates the upper gate assembly 44 via gate air hose 58A allowing one pin to drop through feed tube 62 into trough 70. Next, the CPU 110 activates cylinder air hose 88 which drives the push rod 80 and trigger block 82 away from the cylinder 86, forcing the pin towards the crimp gun 102. Next, the CPU 110 in step 356 monitors the fiber optic detector, which is coupled to the cylinder mount 65, to determine when the pin has been properly seated within crimp gun 102. Once the CPU 110 determines that the pin has been properly positioned, it proceeds to step 358 and no longer suppresses the crimp gun 102 from being triggered. Then, the CPU 110 returns to the main routine 200, shown in FIG. 11, and proceeds to step 212, where it inputs data from fiber optic detector 119 to determine if the pin had been properly seated.

After completing step 212 or if during step 204 the CPU 110 determines that the pin button has not been pushed, then the CPU 110 proceeds to step 214 to check if the socket button 117B of panel 112, shown in FIG. 10, has been pushed. If the socket button 117B has been pushed, then the CPU 110 proceeds to step 216 and turns on the first and second vibrating bowls 24 and 26 in step 216. Next the CPU 110 proceeds to step 218, where the CPU 110 invokes the subroutine 300, shown in FIG. 12. Once the CPU 110 has completed subroutine 300, it returns to the main routine 200 and proceeds to step 220, shown in FIG. 11.

Figure 14:
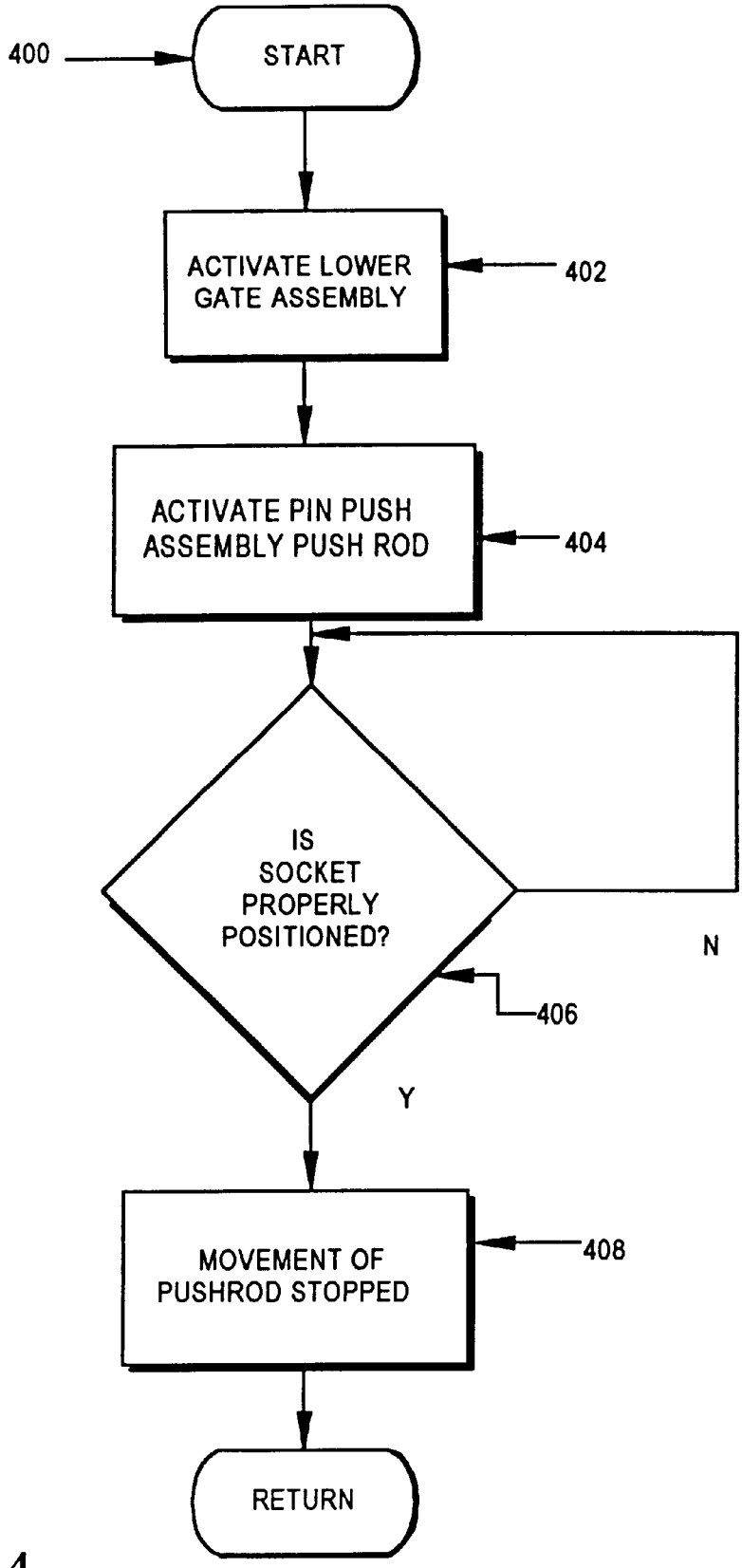
FIG. 14 shows a flow chart of subroutine invoked to load a socket into proper position relative to the trigger assembly.

In step 220, the CPU 110 invokes a subroutine 400, shown in FIG. 14, which loads a socket into the crimp gun 102. In step 402, the CPU 110 activates the lower gate assembly 46, allowing one socket to be fed through the feed tube 62 into trough 70. Then, the CPU 110 proceeds to step 404 where it moves the push rod 80 of the push assembly 28 by instructing the pneumatic system to apply air to cylinder air hose 88 moving the socket towards the crimp gun 102. Next, the CPU 110 proceeds to step 406 in subroutine 400 where it monitors the fiber optic detector 67, which coupled to the cylinder mount 65, to determine if the socket reached its proper location in the crimp gun 102. If the fiber optic detector has not yet been triggered, then the push rod 80 continues to be driven towards the crimp gun 102. Once the CPU 110 determines that the socket has been properly positioned, it proceeds to step 408 it allows the crimp gun 102 to be automatically triggered and then returns to the main program 200, shown in FIG. 11 at step 220. Next, the CPU 110 proceeds to step 222 where it inputs data from fiber optic detector 119 to determine if the socket was properly seated.

If the CPU 110 determines that the socket button 117B was not pushed in step 214, or if the CPU 110 completed step 222, then it proceeds to step 224 and determines if the funnel open button 117C of the panel 112, shown in FIG. 10, has been activated. If the button 117C has been activated, then the CPU 110 proceeds to step 226 and turns on first and second vibrating bowls 24 and 26. The CPU 110 then proceeds to step 228 and opens the alignment funnel 104, as discussed above, by supplying air through the open funnel air hose 105, shown in FIG. 8.

If the CPU 110 in step 224 determines that the funnel open button has not been pushed, or if step 228 has been completed, then the CPU 110 proceeds to step 230. In step 230, the CPU 110 determines if the funnel close button 117D on the panel 112, shown in FIG. 10, has been activated. If the funnel close button has been activated, then the CPU 110 proceeds to step 232, and turns on first and second vibrating bowls 24 and 26. Next the CPU 110 proceeds to step 234 in the main routine 200 and closes the alignment funnel 104 by supplying the air through the close funnel air hose 109 causing the upper and lower alignment funnel bodies 106A and 106B to be drawn together.

If the CPU 110 in step 230 determines that the funnel close button 117D has not been activated, or the CPU 110 has completed step 234, then the CPU 110 proceeds step 236 and checks whether the fire gun button 117E on panel 112, shown in FIG. 10, has been activated. If the fire gun button 117E has been activated, then the CPU 110 proceeds to step 238 and turns on the first and second vibrating bowls 24 and 26. The CPU 110 then proceeds to step 240 and activates the crimp gun 102, by applying air to the crimp gun 102 via crimp air hose 103, shown in FIG. 8. However, if the CPU 110 in step 236 determines that the fire gun button has not been pushed, or the CPU 110 has completed step 240, then the CPU 110 proceeds to step 242 and determines whether the clear button 117F on panel 112, shown in FIG. 10, has been activated. If the clear button 117F has been activated, then the CPU 110 proceeds to step 244 and turns on the first and second vibrating bowls 24 and 26, and proceeds to step 246. In step 246, the CPU 110 invokes subroutine 300.

If the CPU 110 in step 242 determines that the clear button 117F was not pushed, or the CPU 110 has completed step 246, then the CPU 110 proceeds to step 248 and determines whether the stripped end of a wire has been properly seated within a contact currently positioned in the crimp gun 102. The CPU 110 receives such notification when a force is applied to push rod 80 in a direction toward the trigger block 82 and the cylinder 86 causing the air dam 92 to open and activating the electronic switch 73 that is in electrical communication with the CPU 110. If this occurs, the CPU 110 proceeds to step 250 in the main routine 200, and turns on the first and second vibrating bowls 24 and 26. Next, in step 251, the fiber optic sensor 119 determines whether a contact has been properly placed in the trigger assembly 30. If no, then the CPU 110 proceeds to step 260. However, if the CPU 110 determines in step 251 that a contact is properly in the trigger assembly, then it proceeds to step 252 and fires the crimp gun 102. After the CPU 110 has fired the crimp gun 102, it proceeds to step 254 and opens the alignment funnel 104 by separating the upper portion 104A and the lower portion 104B, allowing the crimp/wire assembly to be removed from the front of the crimping apparatus 20. Next, the CPU 110 proceeds to step 255 and uses the fiber optic sensor 119 to determine if the crimped wire assembly has been removed. If the crimped product has been removed, then the CPU 110 proceeds to step 256 and closes the alignment funnel 104 in the manner described above. If the crimped product has not been removed, the CPU 110 waits until it is removed before continuing the cycle. Thus the crimped product cannot be caught in the alignment funnel 104, as it is closing. Once the alignment funnel 104 has been closed, the CPU 110 proceeds to step 258 and reloads the crimp gun 102 with a contact by invoking either subroutine 350 or 400 depending on whether a pin or socket was previously loaded into the crimp gun 102.

If the crimping apparatus 20 remains on, or the CPU 110 in step 248 determines that the crimp gun 102 should not be activated, then the CPU 110 proceeds to step 260 and determines whether the vibrating bowls 24 and 26 have remained on for more than five minutes without the crimping apparatus 20 being operated. If the five minute interval has not yet occurred, then the CPU 110 proceeds to step 262 and turns the vibrating bowls 24 and 26 back on or allows them to remain on. However, if the CPU 110 determines that the crimping apparatus 20 has not been in use for at least five minutes, then it proceeds to shut down the first and second vibrating bowls 24 and 26 and begins the process over again at step 204.

The present invention offers the advantage of providing a plurality of types of contacts to a single stationary crimp gun in a reliable manner that requires little maintenance. The crimp gun automatically crimps the end of a wire when it is properly positioned completely within the barrel of the contact, and does not require the wire to be conductive, to activate the crimp gun. Also needs no foot pedal and self determines the cycle time to compensate for operator speed.

While the detailed description above has been expressed in terms of a specific example, those skilled in the art will appreciate that many other structures could be used to accomplish the purpose of the disclosed procedure and apparatus. Accordingly, it can appreciated that various modifications in the above-described embodiment may be made without departing the spirit and scope of the invention. Therefore, the spirit and scope of the present invention are to be limited only by the following claims.

What is claimed is:

1. A method for automatically coupling a contact, having a tip portion and a barrel portion, to a stripped end of an insulated wire using a crimping gun having at least a pair of opposed jaws, said method comprising the steps of:

transporting a contact to a pre-determined position between said pair of opposed jaws of said crimping gun, by pushing said tip portion of said contact in a first direction with a distal end of a push rod until said barrel portion of said contact is in said pre-determined position, said push rod holding its position to insure said contact remains in said pre-determined position;

feeding said stripped end of said insulated wire into said barrel portion of said contact;

sensing that said stripped end of said insulated wire has made contact with a rear most portion inside of said barrel portion of said contact by detecting movement of said push rod in a second direction that is opposite to said first direction in which said contact was pushed and sending out a first signal; and actuating said crimping gun in response to said first signal in order to deformably couple said contact to said stripped end of said insulated wire.

2. The method of claim 1 wherein said step of feeding said stripped end further includes the step of:

guiding said insulated wire through an alignment funnel having a rear portion adjacent to said barrel portion of said contact.

3. The method of claim 1 wherein said step of detecting said movement of said rod in said second direction includes:

causing an end of said rod opposite to said distal end to influence a flow path.

4. The method of claim 3 wherein said flow path is traveled by a beam of light.

5. The method of claim 3 wherein said flow path is traveled by a stream of air.

6. An apparatus for automatically engaging a contact, having a tip portion and a barrel portion, to a stripped end of an insulated wire, said apparatus comprising:

a crimping gun having at least a pair of opposing jaws;

a push rod having a distal end that engages said tip portion of said contact and moves said contact to a predetermined position between said jaws of said crimping gun;

a detector that sends out a first signal upon sensing that said stripped end of said insulated wire has made contact with a rear most portion inside of said barrel portion of said contact, wherein said detector includes:

a dam coupled to an end of said push rod opposite to said distal end;

a trigger block containing at least one flow path which is influenced by said dam when said stripped end of said wire makes contact with said rear most portion inside of said barrel of said contact; and a CPU in communication with said crimping gun and said detector, said CPU directing said crimping gun to deformably couple said contact to said stripped end of said insulated wire upon receipt of said first signal from said detector.

7. The apparatus of claim 6 wherein said flow path includes a first air flow path, and a second air flow path, and wherein said dam obstructs a flow of air from said first air flow path to second air flow path, said dam including an orifice which is moved between said first air flow path and said second air flow path to provide said influence by allowing the flow of air which triggers a switch that sends said first signal.

8. The apparatus of claim 6 wherein said flow path includes path in which light from a fiber optic transmitter travels towards a fiber optic receiver, and wherein said dam obstructs said light, said dam including an orifice which is moved to provide said influence by allowing said fiber optic receiver to receive said light, and transmit said first signal.

9. The apparatus of claim 6 wherein said apparatus further includes:

an alignment funnel having a front most portion sized to receive said insulated wire and a rear most portion sized less than a diameter of said barrel portion of said contact.

10. The apparatus of claim 9 wherein said alignment funnel includes an upper body and a lower body, wherein said upper body and said lower body are held together by a first source of air pressure, and said upper body and said lower body are drawn apart by a second source of pressure.

11. The apparatus of claim 10 wherein a difference in said first pressure from said second pressure allows said upper body of said alignment funnel to be separated from said lower body of said alignment funnel with a nominal amount of force applied by the movement of said insulated wire into said alignment funnel.

* * * * *